US008978773B2

(12) United States Patent
Tilley

(10) Patent No.: US 8,978,773 B2
(45) Date of Patent: Mar. 17, 2015

(54) SLIDING SLEEVE BYPASS VALVE FOR WELL TREATMENT

(71) Applicant: Halliburton Energy Services, Inc., Houston, TX (US)

(72) Inventor: David J Tilley, Franklin, LA (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 14/349,534

(22) PCT Filed: Mar. 13, 2013

(86) PCT No.: PCT/US2013/031019
§ 371 (c)(1),
(2) Date: Apr. 3, 2014

(87) PCT Pub. No.: WO2014/142849
PCT Pub. Date: Sep. 18, 2014

(65) Prior Publication Data

US 2014/0262312 A1 Sep. 18, 2014

(51) Int. Cl.

| | |
|---|---|
| ***E21B 34/14*** | (2006.01) |
| ***E21B 23/04*** | (2006.01) |
| ***E21B 43/14*** | (2006.01) |
| *E21B 34/00* | (2006.01) |

(52) U.S. Cl.
CPC ..... *E21B 34/14* (2013.01); *E21B 23/04* (2013.01); *E21B 43/14* (2013.01); *E21B 2034/007* (2013.01)
USPC ..... 166/351; 166/345; 166/373; 166/386; 166/194; 166/318

(58) Field of Classification Search
CPC .... E21B 34/10; E21B 34/14; E21B 2034/007
USPC ..... 166/351, 344, 345, 373, 386, 193, 194, 166/318
See application file for complete search history.

(56) References Cited

U.S. PATENT DOCUMENTS 5,048,611 A * 9/1991 Cochran ..... 166/374
6,609,569 B2 * 8/2003 Howlett et al. ..... 166/264

(Continued)

OTHER PUBLICATIONS

International Search Report dated Nov. 26, 2013 for Application No. PCT/US2013/031019.

(Continued)

*Primary Examiner* — Matthew Buck
(74) *Attorney, Agent, or Firm* — Haynes and Boone, LLP

(57) ABSTRACT

A downhole bypass valve utilizes a stationary sleeve defining an interior ball-seat. When a dropped ball is seated, fluid differential pressure is diverted to an annular area adjacent a first sliding sleeve. The sleeve slides in response to the pressure differential upon shearing of a shear pin, or similar, and opens ports to the wellbore annulus. Treatment or maintenance operations can then occur through the ports, which can be fitted with nozzles. A second sliding sleeve, independent from the first, is operated in response to dropping a second ball into the device. The second ball diverts fluid differential pressure to an annular area adjacent the second sleeve and movement occurs when a shear pin shears. The second sleeve covers the ports to the wellbore annulus and closes the valve. After a sliding sleeve shifts, pressure across the sleeve is equalized, allowing reverse flow without risk of accidental sleeve actuation.

27 Claims, 4 Drawing Sheets

(56) References Cited

U.S. PATENT DOCUMENTS

| | | | | |
|---|---|---|---|---|
| 2003/0188866 | A1 | 10/2003 | Bissonnette et al. | |
| 2006/0213670 | A1* | 9/2006 | Bishop et al. | 166/386 |
| 2009/0084553 | A1 | 4/2009 | Rytlewski et al. | |
| 2011/0203809 | A1* | 8/2011 | Knobloch et al. | 166/386 |
| 2012/0012322 | A1* | 1/2012 | Korkmaz et al. | 166/308.1 |
| 2013/0056220 | A1* | 3/2013 | Sommers et al. | 166/373 |

OTHER PUBLICATIONS

Written Opinion dated Nov. 26, 2013 for Application No. PCT/US2013/031019.

* cited by examiner

SLIDING SLEEVE BYPASS VALVE FOR WELL TREATMENT

CROSS-REFERENCE TO RELATED APPLICATIONS

None.

FIELD OF INVENTION

Methods and apparatus are presented for selective treatment of a wellbore or formation. More specifically, the inventions relate to methods and apparatus for selective fluid communication between a work string and wellbore utilizing a sliding-sleeve, bypass valve device.

BACKGROUND OF INVENTION

The present inventions relate, generally, to apparatus and methods used in well servicing and treatment operations. More specifically, these inventions relate to downhole apparatus used to selectively provide a flow passage from a tubular string into the wellbore annulus between the tubular string and the casing (or open hole) in which it is run.

As is common in the art, nozzles or ports can be utilized to inject fluid into the annulus surrounding a tubing string to clean various components in the wellbore. For example, cleaning of subsea surfaces and profiles of subsea wellheads, blowout preventers (BOPs) and the like, lifting fluid above liner tops and the like to increase annular flow, etc. In other applications, fluids are injected into the annulus to assist circulation. In a staged fracturing operation, multiple zones of a formation need to be isolated sequentially for treatment. Fracturing valves typically employ sliding sleeves, usually ball-actuated. The sleeves can be one-way valves or can be capable of shifting closed after opening. Initially, operators run the string in the wellbore with the sliding sleeves closed. A setting ball close the interior passageway of the string by seating on a ball seat. This seals off the tubing string so, for example, packers can be hydraulically set. At this point, fracturing surface equipment pumps fluid to open a pressure actuated sleeve so a first zone can be treated. As the operation continues, successively larger balls are dropped down the string to open separate zones for treatment.

Despite the general effectiveness of such assemblies, practical limitations restrict the number of balls that can be run in a single tubing string. Moreover, depending on the formation and the zones to be treated, operators may need a more versatile assembly that can suit their immediate needs. Further, staged sliding sleeves can tend to "skip" positions in response to raised tubing pressure, creating issues with opening a zone to treatment, etc.

SUMMARY OF THE INVENTION

The disclosed downhole bypass valve utilizes a stationary sleeve defining an interior ball-seat. When a dropped ball is seated, fluid differential pressure is diverted to an annular area adjacent a first sliding sleeve. The sleeve slides in response to the pressure differential upon shearing of a shear pin, or similar, and opens ports to the wellbore annulus. Treatment or maintenance operations can then occur through the ports, which can be fitted with nozzles. A second sliding sleeve, independent from the first, is operated in response to dropping a second ball into the device. The second ball diverts fluid differential pressure to an annular area adjacent the second sleeve and movement occurs when a shear pin shears. The second sleeve covers the ports to the wellbore annulus and closes the valve. After a sliding sleeve shifts, pressure across the sleeve is equalized, allowing reverse flow without risk of accidental sleeve actuation. Accidental shifting or "skipping" of sleeve positions is reduced as the sleeves are independently operated.

The tool is limited to one full cycle (close-open-close), however, different diameter inner sleeves and ball seats can be used to accept different ball sizes, allowing multiple tools to be stacked vertically for additional cycles.

BRIEF DESCRIPTION OF THE DRAWINGS

For a more complete understanding of the features and advantages of the present invention, reference is now made to the detailed description of the invention along with the accompanying figures in which corresponding numerals in the different figures refer to corresponding parts and in which.

It should be understood by those skilled in the art that the use of directional terms such as above, below, upper, lower, upward, downward and the like are used in relation to the illustrative embodiments as they are depicted in the figures, the upward direction being toward the top of the corresponding figure and the downward direction being toward the bottom of the corresponding figure. Where this is not the case and a term is being used to indicate a required orientation, the Specification will state or make such clear.

DETAILED DESCRIPTION OF PREFERRED EMBODIMENTS

While the making and using of various embodiments of the present invention are discussed in detail below, a practitioner of the art will appreciate that the present invention provides applicable inventive concepts which can be embodied in a variety of specific contexts. The specific embodiments discussed herein are illustrative of specific ways to make and use the invention and do not limit the scope of the present invention. The description is provided with reference to a horizontal wellbore. However, the inventions disclosed herein can be used in horizontal, vertical, or deviated wellbores. As used herein, the words "comprise," "have," "include," and all grammatical variations thereof are each intended to have an open, non-limiting meaning that does not exclude additional elements or steps. The terms "uphole," "downhole," and the like, refer to movement or direction closer and farther, respectively, from the wellhead, irrespective of whether used in reference to a vertical, horizontal or deviated borehole. The terms "upstream" and "downstream" refer to the relative position or direction in relation to fluid flow, again irrespective of the borehole orientation. Those of skill in the art will recognize where the inventions disclosed herein can be used in conjunction with jointed tubing string, coiled tubing, or wireline. The inventions herein can also be used with onshore rigs, off-shore rigs, subsea and deep-sea rigs, etc.

Figure 1:
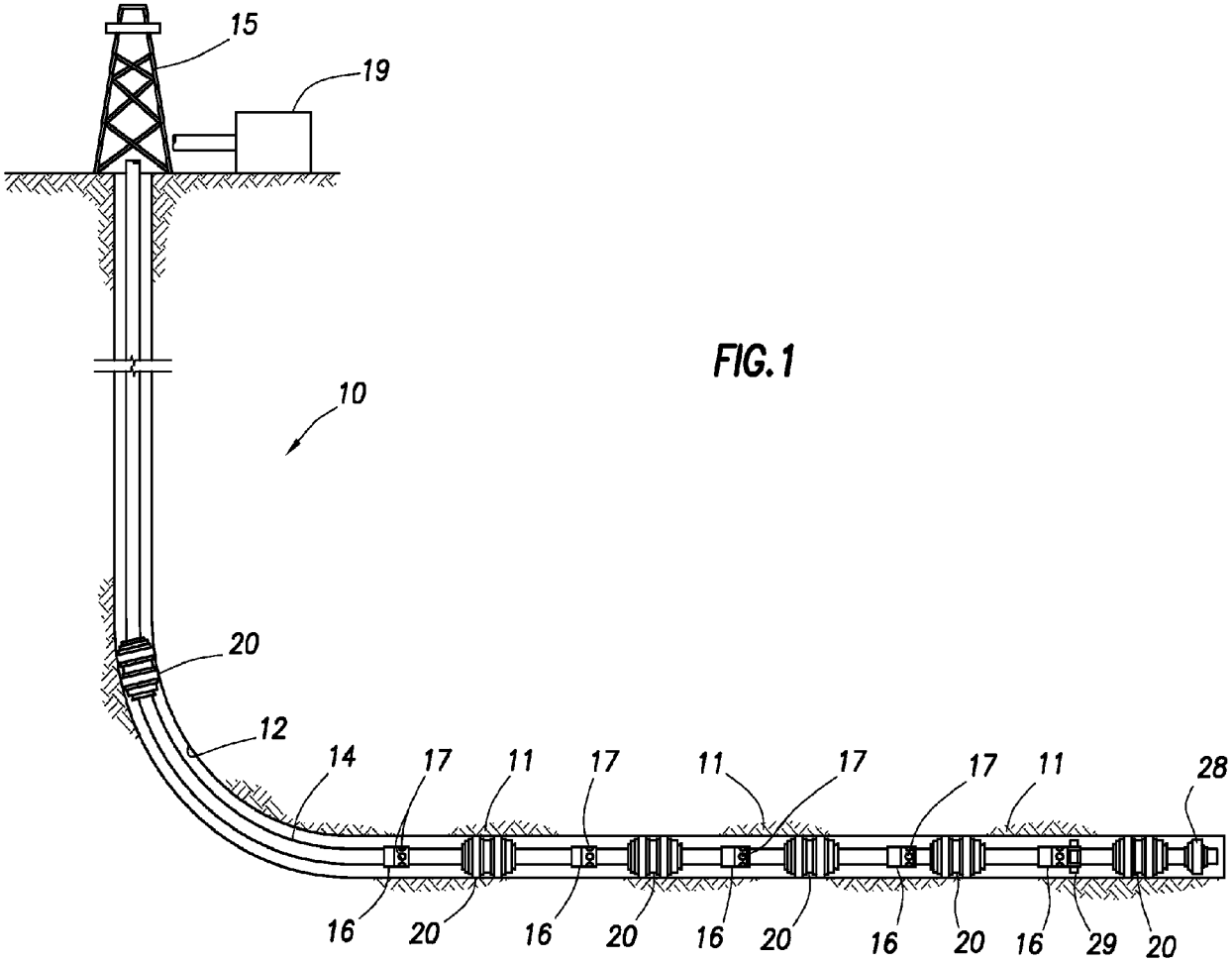
FIG. 1 is a schematic view of an exemplary embodiment of a work string having a plurality of valve assemblies thereon according to an aspect of the invention.

FIG. 1 is a schematic view of a typical tubing string positioned in a subterranean wellbore. As used herein, "tubing string," "work string," and the like are used interchangeably and are to be construed as inclusive of various types of string or strings for various operations, such as work strings, workovers, servicing, production, injection, stimulation, etc. The tool can also be used as a jetting and bypass tool in various operations, including BOP jetting, bore cleaning, fluid displacements, drilling and displacement boosting, as a drain sub, etc. The apparatus is useful for stimulation of a formation, using stimulation fluids, such as for example, acid, gelled acid, gelled water, gelled oil, nitrogen, or proppant laden fluids. The apparatus may also be useful to open the tubing string to production fluids. Further, the device can be used in injection, fracturing, staged fracturing, and other treatment operations.

FIG. 1 shows a well system 10 having a wellbore 12 extending through one or more subterranean formations or zones 11. A work string 14 is positioned in the wellbore and has a plurality of sliding sleeve-operated valve devices 16. Other string configurations, varying numbers and spacing of devices, etc., can be used, as will be apparent to those of skill in the art. In the assembly illustrated, the sleeves are used to control fluid flow through the string and into selected zones 11 through the wellbore 12. Tubing string 14 includes a plurality of spaced-apart, selectively operable, sliding sleeve valve devices 16 each having a plurality of ports 17 extending through the tubing wall to selectively permit fluid flow between the tubing string inner bore and the annulus between the work string and wellbore 12. Any number of devices 16 can be used in each interval, grouped adjacent one or more target zones, etc. A plurality of annular sealing devices 20 is mounted on the string between sliding sleeve devices 16. Exemplary annular sealing devices include mechanically, hydraulically, electromechanically, chemically, or temperature-activated packers, plugs, etc., as are known in the art. The annular sealing devices can be used to isolate formation zones, or sections of wellbore, for interval treatment, etc. The packers are disposed about the tubing string and selected to seal the annulus between the tubing string and the wellbore wall, when the assembly is disposed in the wellbore. The packers divide the wellbore into isolated sections so that fluid can be applied to selected sections of the well, but prevented from passing through the annulus into adjacent segments. As will be appreciated, the packers can be spaced in any way relative to the ported intervals to achieve a desired interval length or number of ported intervals per segment.

Sliding sleeve devices 16 are disposed along the tubing string to selectively control the opening and closing of the ports. A sliding sleeve is mounted to control flow through each ported valve. In a preferred embodiment, the valve devices are closed during run-in and can be opened, and later closed, to allow and stop fluid flow into the wellbore. The assembly is run-in and positioned downhole with the sliding sleeve devices in closed positions. The sleeves are selectively moved to an open position when the tubing string is ready for use in fluid treatment of the wellbore. The sliding sleeve valve devices 16 for each isolated section can be opened individually and sequentially to permit fluid flow to the wellbore.

The sliding sleeve valve devices are each moveable between closed and open positions by selective application of tubing pressure and without having to run a line for manipulation. The valve devices are actuated by a dropped ball (not shown). The term "ball" as used herein includes alternates such as darts, bars, or other plugging device, which can be conveyed by gravity or fluid flow through the tubing string. The dropped ball engages a seat positioned in the valve device and plugs fluid flow through the interior bore of the string. When pressure is applied through the tubing string bore, the ball creates a pressure differential across the valve. This pressure differential is used to operate the valve, sliding a sleeve in the valve and opening the associated ports. Fluid flows into the wellbore annulus and into contact with the formation.

Multiple sliding sleeve valve devices 16 can be used by dropping sequentially larger diameter balls which mate with sequentially larger ball seats. In particular, the lower-most device has the smallest diameter seat and each device progressively closer to surface has a larger diameter seat. The preferred embodiment disclosed herein also provides for the selective closing of the sliding sleeve valve device by dropping of a subsequent ball.

At the surface is an appropriate rig, 15 derrick or the like, and various other surface equipment 19, such as pumping equipment, etc., as in known in the art for well servicing and treatment operations.

The lower end 28 of the tubing string 14 can be open, closed, or fitted in various ways, depending on the operational characteristics of the tubing string that are desired. Further components and tools can be used in conjunction with the tubing string, such as additional sealing devices, connection joints, measuring and sensing equipment, downhole pumps, valves, tool actuators, communication lines, transmission devices, etc., as those of skill in the art will recognize.

Figure 2:
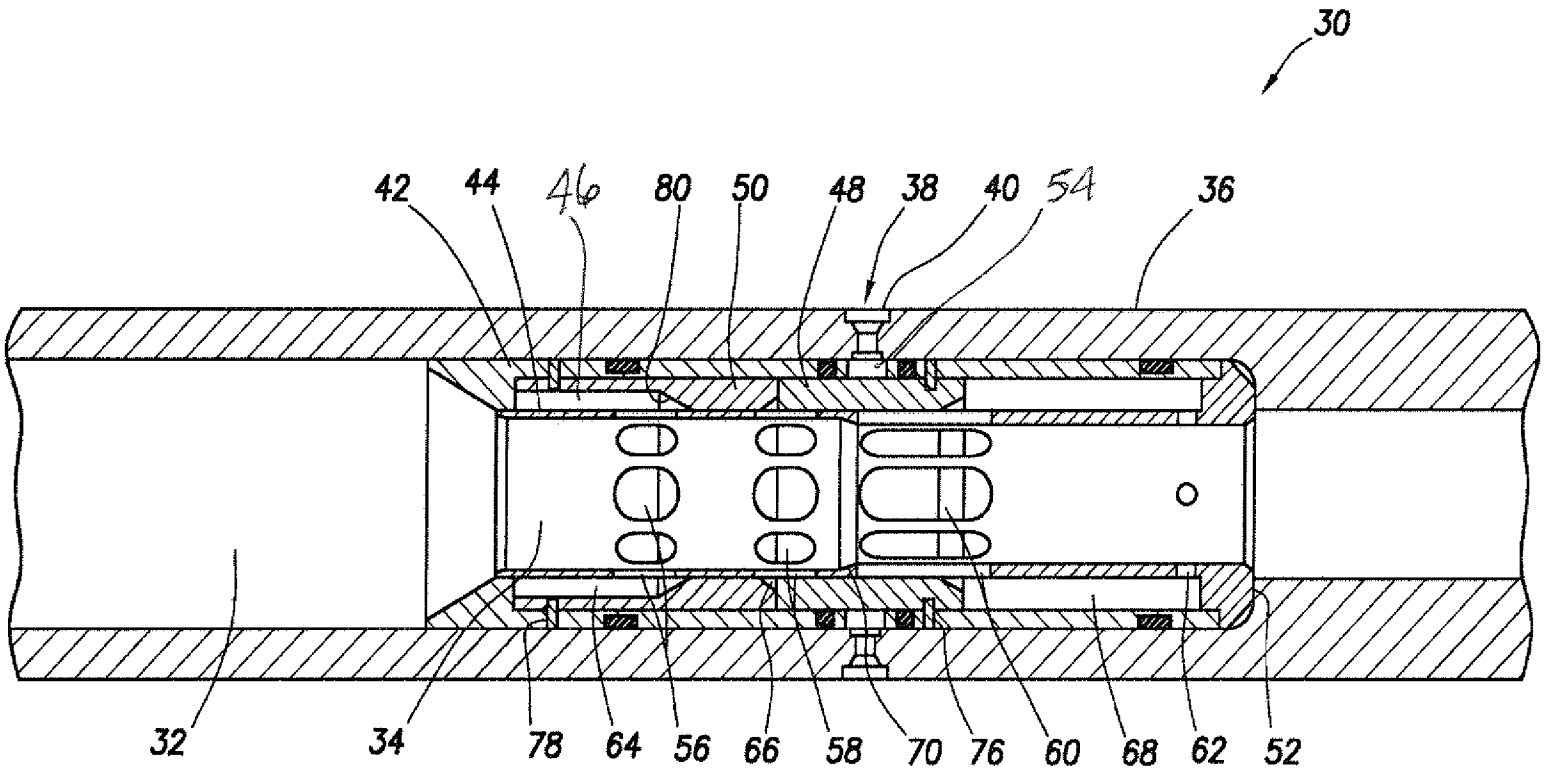
FIG. 2 is a cross-sectional schematic of an exemplary valve device according to an aspect of the invention with the valve in an initial closed, or run-in, position.
Figure 3:
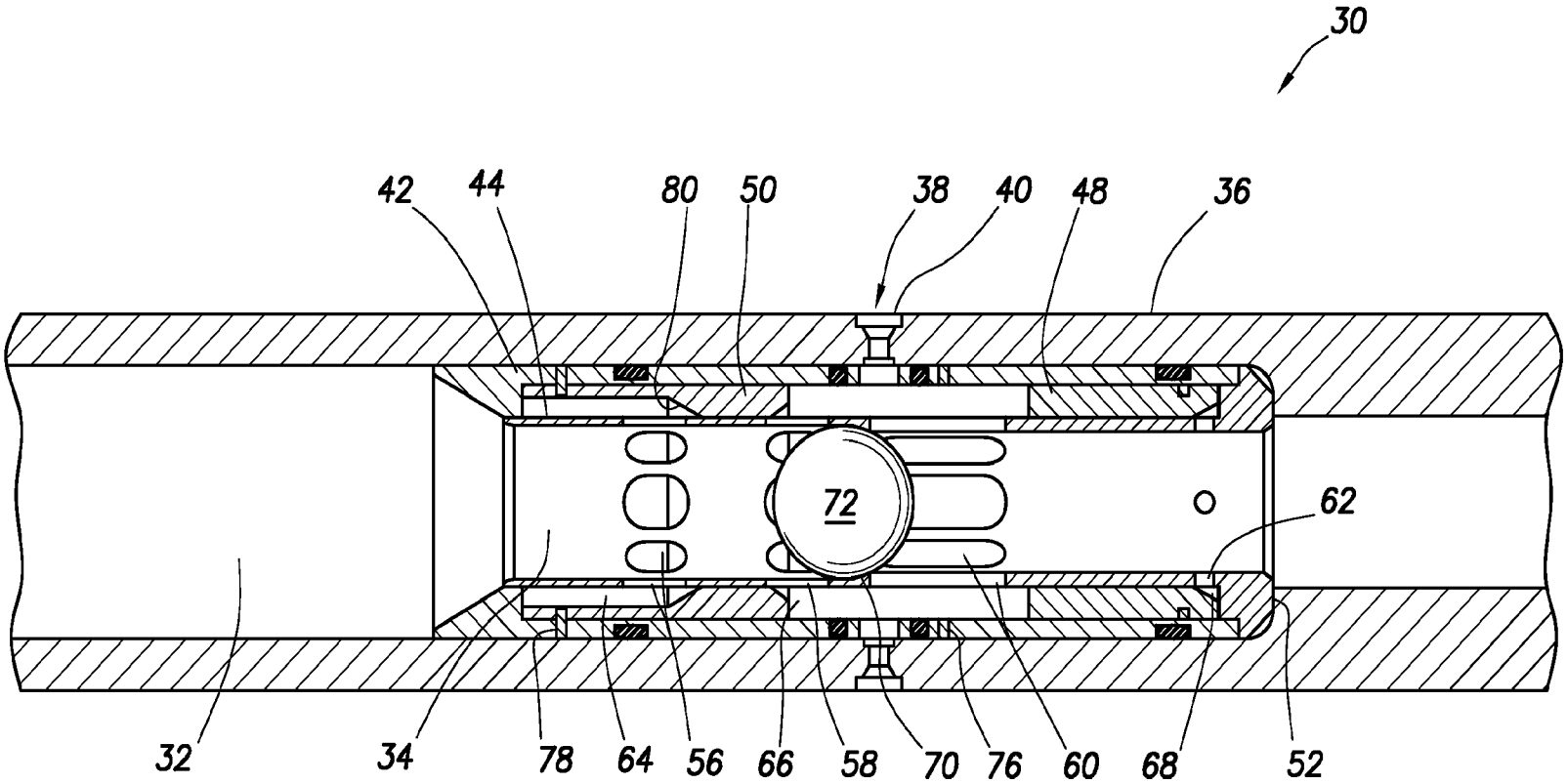
FIG. 3 is a cross-sectional schematic of the exemplary valve device of FIG. 2, with the valve in an actuated open position.
Figure 4:
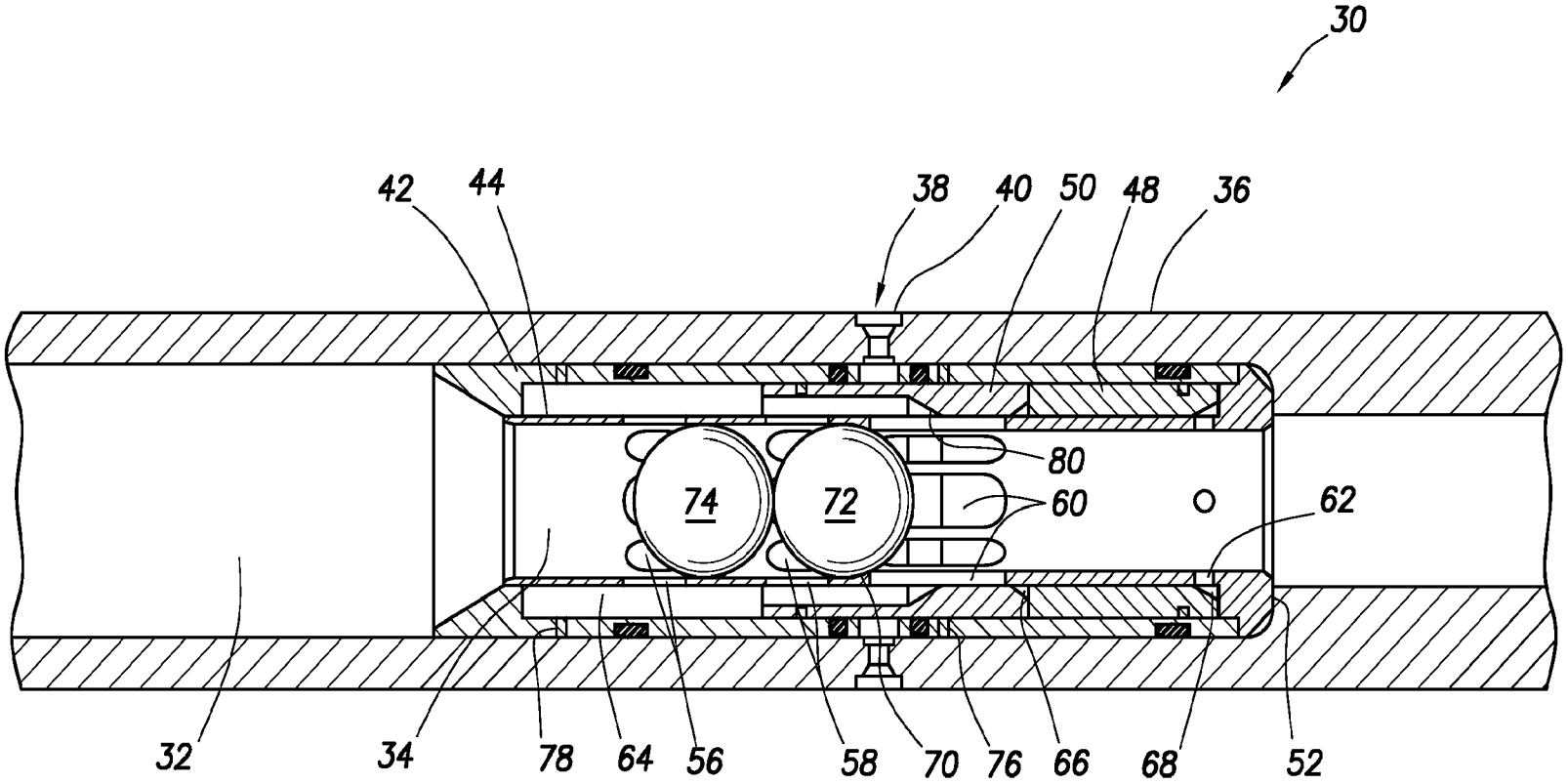
FIG. 4 is a cross-sectional schematic of the exemplary valve device of FIG. 2, with the valve in a final closed position.

FIG. 2 is a cross-sectional schematic of an exemplary valve device according to an aspect of the invention with the valve in an initial closed, or run-in, position. FIG. 3 is a cross-sectional schematic of the exemplary valve device of FIG. 2, with the valve in an actuated open position. FIG. 4 is a cross-sectional schematic of the exemplary valve device of FIG. 2, with the valve in a final closed position. The figures will be discussed together with specific references to particular figures as necessary. The exemplary embodiment shown here is of particular use in jetting and bypass operations, such as BOP jetting, bore cleaning, etc. Variations known in the art to practitioners can be employed for use of the device for fluid displacements, drilling and displacement boosting, as a drain sub, stimulation, fracturing, production, etc.

The tool embodiment shown is a downhole, ball-actuated, jetting or bypass valve. The valve is ball-actuated and provides for one complete cycle (closed-open-closed). The tool preferably has four sleeves positioned in a tool body or housing: two sliding or shifting sleeves, one for opening the valve and one for closing the valve, a stationary ball-seat sleeve, and a retaining sleeve. When a dropped or pumped ball lands on the seat in the seat sleeve, a pressure differential is created on an upwardly-facing annular area of the first sliding sleeve. When the differential is high enough, a shear pin is sheared and the first sliding sleeve shifts, uncovering ports and opening the tool to fluid flow into the wellbore annulus. Similarly, dropping a second ball acts on the second sliding sleeve, shifting the second sleeve to a closed position and shutting off flow to the wellbore annulus.

Both opening and closing sleeves are fully independent, eliminating any concerns of double-shifting or "skipping" the open position. Following activation and deactivation, both shifting sleeves are pressure equalized, meaning full reverse circulation can occur without concerns of reverting back to a previous position. Internal sleeves can be assembled outside of the main body for ease of assembly. Flow area after activation is preferably equal to or greater than before activation. The open-bore design allows wireline tools to be run in conjunction with, and through, the device prior to activation.

An exemplary sliding sleeve device 30 is attached to, and forms part of, a work string. The work string has a fluid flow passageway 32, typically a central bore, for passing fluid between downhole locations and the surface. The fluid flow passageway includes a fluid passageway 34 defined in the device 30. Fluid can be flowed through the device to locations downhole or uphole when the device is in its run-in or initial position, as seen in FIG. 2.

The device 30 has a generally tubular housing 36 which is attachable to a work string by methods known in the art. A plurality of radial ports 38 extend through the housing, providing fluid communication between the wellbore annulus and the interior of the device. The ports 38 are shown extending radially at a right angle to the longitudinal axis of the device, although alternate orientations can be used. The ports 38 can be altered or designed for the specific use of the device. For example, as shown, the ports 38 are fitted with jetting nozzles 40, which can be selected based on expected use and which are preferably exchangeable for different nozzles 40 of varying size, for more or less flow splitting, for jetting velocity and spray pattern, etc. In a preferred embodiment, the nozzles 40 are inserted through aligned holes or ports 38 and 54 in the housing 36 and retaining sleeve 42, serving to orient the internal parts of the device and to lock the housing and retaining sleeve axially and radially.

The exemplary valve device 30 has a retaining sleeve 42 and a stationary internal sleeve or ball-seat sleeve 44. Defined between, and preferably by the surfaces of, the retaining sleeve 42 and ball-seat sleeve 44 is an annular space 46 for two sliding sleeves, a first or lower sliding sleeve 48 and a second or upper sliding sleeve 50. The retaining sleeve 42 is positioned in the housing and remains stationary in use. The retaining sleeve can be attached to the housing by means known in the art. Similarly, the interior ball-seat sleeve 44 remains stationary in use and can be attached to the housing, the retaining sleeve, or both, by means known in the art. In the embodiment shown, the lower end of the ball-seat sleeve abuts a shoulder 52 defined by the housing. The retaining sleeve has radial ports 54 which align with ports 38 of the housing to allow fluid communication radially across the retaining sleeve. Where nozzles 40 are employed, they can extend into and attach to the ports 54, align the ports 54 and 38, and position and/or lock the retaining sleeve radially and axially to the housing.

The inner sleeve 44 has a generally open interior passageway 34 and defines several radial ports extending through the sleeve wall and providing fluid communication between the passageway and the exterior of the sleeve. As best seen in FIG. 2, the various ports include upper pressure ports 56, lower pressure ports 58, flow ports 60, and pressure equalization ports 62. The upper pressure ports 56 provide fluid communication between the interior passageway 34 and the upper annular chamber 64. Lower pressure ports 58 provide fluid communication between the interior passageway and the central annular chamber 66. Flow ports 60 provide fluid communication between the interior passageway and the lower annular chamber 68. Finally, the pressure equalization ports 62 provide fluid communication between the interior passageway and the lower annular chamber 68.

The inner sleeve 44 has, or defines, a ball seat 70 operable to catch an appropriately sized ball. That is, the ball seat has a diameter slightly smaller than the cooperating ball diameter. The inner sleeve can also have a second ball seat defined therein (not shown) for catching a second ball of slightly larger size. In the preferred embodiment, a second ball seat is unnecessary as the first dropped ball 72 acts to "catch" or stop the second dropped ball 74.

The lower sliding sleeve 48 moves between an initial or closed position, as seen in FIG. 2, and an actuated or open position, as seen in FIG. 3. The lower sliding sleeve is initially held in place by one or more selective release mechanisms, such as a shear ring, shear pin, snap-ring, etc. In a preferred embodiment, the sleeve is held in place by shear pin 76.

The upper sliding sleeve 50 moves between an initial or first position, as seen in FIG. 3, and an actuated or closed position, as seen in FIG. 4. The lower sliding sleeve is initially held in place by one or more selective release mechanisms, such as a shear ring, shear pin, snap-ring, etc. In a preferred embodiment, the sleeve is held in place by shear pin 78.

When the lower sleeve is in the closed position, fluid flow through the ports 38 is blocked. When the lower sliding sleeve is moved to the open position (and the upper sleeve remains in its initial position), as in FIG. 3, fluid is free to flow from interior passageway 34, through lower pressure ports 58, through annular chamber 66, and exit the device and work string into the wellbore annulus through ports 38 and, if present, nozzles 40. When the upper sleeve is moved to its closed position, FIG. 4, fluid is once again blocked from flowing from the interior passageway to the wellbore annulus.

In use, the valve device is attached to a work (or other) string and run-in to the wellbore hole. Typically, the device is run-in in a closed position, such that fluid is blocked from flowing from the interior passageway to the exterior of the device. Once positioned where desired and, if necessary, after other operations have occurred, such as setting isolation devices, etc., the device is ready for use. Fluid flows through the interior passageway 34 which makes up a part of a longer interior passageway 32 of the string. Fluid can be flowed downhole or uphole through the passageway 34 without actuating either sliding sleeve at this point. Further, the interior passageway 34 is sufficiently free of obstructions to allow use of wireline conveyed tools.

When it is desired to open the valve device, a ball (or other similar object) is dropped or flowed into the interior passageway. The ball seats on a cooperating ball seat 70 defined in the interior passageway 34 of the device, preferably on the interior surface of the inner or ball-seat sleeve. The seated ball 72 remains stationary, as does the inner sleeve 44, and blocks or restricts fluid flow through the passageway 34 and creates a pressure differential across the ball. The differential pressure is diverted by the blockage of the passageway, through the pressure ports 58 in the inner sleeve 44, to annular chamber 66, where the pressure acts with downward force on an upper surface of the lower sliding sleeve 48. The sliding sleeve 48, slidingly positioned between the inner sleeve 44 and the retaining sleeve 42, is forced downward, shearing the shear pin 76. Upon shearing of the pin 76, the lower sliding sleeve 48 moves from its initial position, wherein the sleeve blocks fluid flow through ports 38 to the wellbore annulus exterior to the device, to an open position, wherein such flow is allowed. Fluid can now flow from the interior passageway 35 above the first ball 72, through lower pressure ports 58, along annular chamber 66, and through the external ports 38. Fluid is flowed or jetted out of the device through ports 38 and nozzles 40 (if present). Flow can also be allowed from the annular chamber 66 through the flow ports 60 and back into the interior passageway 34 below the first ball 72. Additionally, in a preferred embodiment, flow is allowed between the inner passageway 34 and an annular chamber 68 defined below the lower sliding sleeve 48, through pressure equalization ports 62, such that pressure is equalized across the lower sliding sleeve.

Various wellbore operations can then be performed. For example, nozzles 40, positioned in or adjacent ports 38, can be used for BOP jetting, bore cleaning, and the like. The open ports can be used for fluid displacements, drilling and displacement boosting, as a drain sub, for stimulation, injection, fracturing, production, etc., operations.

When it is desired to close the device, a second ball 74 is dropped into the passageway and seats itself on, or is stopped by contact with, the first ball 72. The second ball 74 blocks fluid flow from the interior passageway 34 through the lower pressure ports 58. As a differential pressure is built across the second ball, the pressure is diverted through the upper pressure ports 56 to annular chamber 64. The seated and stationary ball 72 blocks fluid flow across the device, creating a pressure differential across the device. The differential pressure is diverted through the upper pressure ports 56 in the inner sleeve 44, to annular chamber 64, where the pressure acts with downward force on an upwardly facing surface 80 of the upper sliding sleeve 50. The sliding sleeve 50, slidingly positioned between the inner sleeve 44 and the retaining sleeve 42, is forced downward, shearing the shear pin 78. Upon shearing of the pin 78, the upper sliding sleeve 50 moves from its initial position, wherein the sleeve does not block fluid flow through ports 38 to the wellbore annulus exterior to the device, to a closed position, wherein such flow is blocked. Fluid can now flow from the interior passageway 34 above the second ball 74, through upper pressure ports 56, along annular chamber 64, and through the flow ports 60 back into the interior passageway 34 below the first ball 72. Additionally, in a preferred embodiment, fluid is allowed between the inner passageway 34 and annular chamber 66 (now defined between adjacent upper and lower sliding sleeves), such as through flow ports 60, such that pressure is equalized across the upper sliding sleeve.

Note that in a preferred embodiment, the flow area (which governs flow rate) available after the lower sliding sleeve shift is the same or even greater than the flow area available in the initial or run-in position. The counter-bored portion of the housing 36 and the movement of the sleeve to its open position, opens up an annular flow area between the inner sleeve 44 and retaining sleeve 42. Similarly, after the second ball 74 is dropped and the upper sliding sleeve 50 is shifted, closing (blocking) the ports 38, an annular flow area is opened which is, preferably, as large as or larger than the initial flow area through the passageway 34. The annular flow area is defined between the inner sleeve 44 and the interior surface of the upper sliding sleeve 50. (Alternately, the annular area can be defined in part by the retaining sleeve.) The upper sliding sleeve 50 can have a radially enlarged annular area defined on its upper inner surface for this purpose. These relatively large annular flow areas allow for a greater flow rate through the device than is typical in such bypass valves of similar diameter.

The valve device is limited to a single closed-open-closed cycle. However, multiple devices can be stacked along the work string, with successive uphole devices having successively larger diameter ball seats for use with cooperating dropped balls. In this manner, multiple cycles along a single isolated section is possible, or multiple isolated zones can be treated sequentially.

Upon closure of the valve device, fluid can be flowed and reverse flowed through the device passageway. The upper and lower sliding sleeves will not shift positions as they are pressure balanced. For example, fluid can be produced from the formation into the tubing string, the wellbore can be drained or flushed of fluids, etc. It is also possible to provide for locking of the sliding sleeves in their activated positions, such as by cooperating profiles, snap rings, etc.

Also note that the device is designed such that a valve assembly, comprising the retaining sleeve, two sliding sleeves and inner sleeve, can be assembled into a unit, and then inserted into (or removed from) a counter-bored housing. This eases assembly, disassembly, allows for interchangeable units of varying diameter seats, etc.

For further disclosure regarding bypass valves and the like, see the following references, all of which are incorporated herein by reference in their entirety for all purposes: U.S. Pat. No. 8,215,411 to Flores, et al.; U.S. Pat. No. 7,201,232 to Turner, et al.; U.S. Pat. Nos. 7,150,326; 6,877,566; 6,467,546 to Allamon, et al.; U.S. Pat. Nos. 6,253,861; and 6,065,541; and U.S. Pat. App. Pub. No. 2011/0278017 to Themig, et al. Also see, for example, commercial bypass valve tools, such as the Jet Tech (trade name) tool available commercially from Halliburton Energy Services, Inc., and Bico Drilling Tools, Inc., Multiple Activation Bypass Tool (see, on-line literature at bicodrilling.com, Multiple Activation Bypass Tool, etc.) also available commercially.

In the preferred and exemplary methods presented hereinabove, various method steps are disclosed, where the steps listed are not exclusive, can sometimes be skipped, or performed simultaneously, sequentially, or in varying or alternate orders with other steps (i.e., steps XYZ can be performed as XZY, YXZ, YZX, ZXY, etc.) (unless otherwise indicated), and wherein the order and performance of the steps is disclosed additionally by the claims appended hereto, which are incorporated by reference in their entirety into this specification for all purposes (including support of the claims) and/or which form a part of this specification, the method steps presented in the following text. Exemplary methods of use of the invention are described, with the understanding that the invention is determined and limited only by the claims. Those of skill in the art will recognize additional steps, different order of steps, and that not all steps need be performed to practice the inventive methods described.

While this invention has been described with reference to illustrative embodiments, this description is not intended to be construed in a limiting sense. Various modifications and combinations of the illustrative embodiments as well as other embodiments of the invention, will be apparent to person skilled in the art upon reference to the description. It is, therefore, intended that the appended claims encompass any such modifications or embodiments.

It is claimed:

1. A method for servicing a subterranean wellbore extending through a formation, the method comprising the steps of:

a) positioning at a downhole location a sliding sleeve valve device, the device having an inner sleeve defining a longitudinal passageway therethrough, the inner sleeve positioned in, and stationary with respect to, a generally tubular housing, and a first sliding sleeve and a second sliding sleeve positioned for sliding movement in an annular space between the inner sleeve and housing;

b) flowing fluid through the device passageway;

c) positioning a first ball on a ball seat defined in the inner sleeve;

d) blocking fluid flow through the device passageway using the first ball;

e) building a first differential pressure across the first ball;

f) applying the first differential pressure, through a first pressure port extending through the wall of the inner sleeve, to a surface of the first sliding sleeve;

g) slidingly moving the first sliding sleeve in response to the first differential pressure;

h) opening radial housing ports through the housing by movement of the first sliding sleeve;

i) flowing fluid through the housing ports from the device passageway to a wellbore annulus defined between the housing and the wellbore;

j) positioning a second ball in the inner sleeve;

k) blocking fluid flow through the device passageway using the second ball;

l) building a second differential pressure across the second ball;

m) applying the second differential pressure, through a second pressure port extending through the wall of the inner sleeve, to a surface of the second sliding sleeve;

n) slidingly moving the second sliding sleeve in response to the second differential pressure;

o) closing the radial housing ports by movement of the second sliding sleeve; and p) flowing fluid through the device passageway.

2. The method of claim 1, wherein step a) further comprises the steps of attaching the device to a tubing string.

3. The method of claim 1, wherein the first and second balls are generally spherical.

4. The method of claim 1, further comprising the step of moving wireline tools through the device passageway prior to step d).

5. The method of claim 1, further comprising the step of setting annular isolation devices positioned in the wellbore prior to step d).

6. The method of claim 1, wherein steps g) and n) further comprise the steps of shearing shearing mechanisms to allow sliding movement of the first and second sliding sleeves.

7. The method of claim 1, wherein differential pressure is built by pumping fluid downhole and into the device passageway in steps e) and l).

8. The method of claim 1, wherein the radial housing ports further include fluid nozzles.

9. The method of claim 1, wherein the device further comprises a retaining sleeve positioned between the first and second sliding sleeves and the housing, the retaining sleeve having radial retaining sleeve ports aligned with the radial housing ports.

10. The method of claim 9, wherein the radial housing ports are fitted with nozzles, and wherein the nozzles maintain the retaining sleeve and housing aligned axially and rotationally.

11. The method of claim 1, wherein the first ball remains stationary with respect to the inner sleeve and housing during at least steps d) through h).

12. The method of claim 1, wherein the second ball remains stationary with respect to the inner sleeve and housing during at least steps k) through o).

13. The method of claim 11, wherein the second ball remains stationary with respect to the inner sleeve and housing during at least steps k) through o).

14. The method of claim 1, further comprising the step of equalizing pressure across the first sliding sleeve in response to step g).

15. The method of claim 14, further comprising the step of equalizing pressure across the second sliding sleeve in response to step n).

16. The method of claim 14, wherein the step of equalizing pressure comprises the step of allowing fluid communication, through pressure equalization ports in the inner sleeve, from the device passageway below the first ball to an annular space below the first sliding sleeve.

17. The method of claim 1, wherein step i) further comprises at least one of cleaning surfaces of a subsea wellhead, cleaning surfaces of a blowout preventer, lifting fluid to increase annular flow, injecting treatment fluids into the wellbore, circulating fluids through the wellbore, or fracturing at least one zone in the formation.

18. The method of claim 1, wherein step i) further comprises the step of flowing fluid from the device passageway above the first ball to the device passage below the first ball by flowing fluid longitudinally through an annular space defined between the inner sleeve and housing, and wherein such fluid flow is allowed by the movement of the first sliding sleeve in step g).

19. The method of claim 18, wherein step i) further comprises flowing fluid through upper and lower radial ports extending through in the inner sleeve, the upper radial ports positioned longitudinally above the first ball and the lower radial ports positioned longitudinally below the first ball.

20. The method of claim 1, wherein step p) further comprises flowing fluid in a reverse direction through the device passageway.

21. The method of claim 20, wherein the step p) further comprises producing hydrocarbon fluid from the formation.

22. The method of claim 1, wherein the device passageway defines a passageway flow area, across which fluid flows when the passageway is unobstructed by a ball, and wherein a bypass flow area is defined by the annular space between the inner sleeve and the housing, after movement of the first sliding sleeve in step g), across which fluid flows after step g), and wherein the bypass flow area is at least as large as the passageway flow area.

23. The method of claim 1, further comprising the step of moving a third ball, unassociated with operation of the device, through the device passageway prior to step c), the third ball having a smaller diameter than the ball seat diameter of the device.

24. The method of claim 1, wherein step a) further comprises positioning at a plurality of downhole locations a corresponding plurality of sliding sleeve valve devices.

25. The method of claim 24, further comprising performing steps as described in steps b) through o) for each of the plurality of sliding sleeve devices positioned in the wellbore, sequentially.

26. A downhole valve device, comprising:

a housing defining an interior passageway therethrough and having a radial housing port for fluid communication between the interior passageway and the exterior of the housing;

a ball-seat sleeve mounted in, and stationary with respect to, the housing, and having a ball seat defined therein for catching a first dropped ball, the first dropped ball for blocking fluid flow through the interior passageway;

a first sliding sleeve slidably mounted in a sliding sleeve annulus defined between the housing and the ball-seat sleeve, the first sliding sleeve movable between an initial, closed position, wherein the first sliding sleeve blocks fluid communication through the radial housing port, and an open position, wherein fluid communication is allowed through the radial housing port; and a second sliding sleeve slidably mounted in the sliding sleeve annulus defined between the housing and the ball-seat sleeve, the second sliding sleeve movable between an initial position, wherein the second sliding sleeve does not block the radial housing port, and a closed position, wherein the second sliding sleeve blocks fluid communication through the radial housing port;

a first pressure port in the ball-seat sleeve providing fluid communication between the interior passageway and the sliding sleeve annulus above the first sliding sleeve when in its closed position and above the ball seat;

a flow port in the ball-seat sleeve providing fluid communication between the interior passageway and the sliding sleeve annulus below the ball seat and above the first sliding sleeve when in its open position; and a second pressure port in the ball-seat sleeve providing fluid communication between the interior passageway and the sliding sleeve annulus above the ball seat and above the second sliding sleeve.

27. A downhole valve device, comprising:

a housing defining an interior passageway therethrough and having a radial housing port for fluid communication between the interior passageway and the exterior of the housing;

a ball-seat sleeve mounted in, and stationary with respect to, the housing, and having a ball seat defined therein for catching a first dropped ball, the first dropped ball for blocking fluid flow through the interior passageway;

a first sliding sleeve slidably mounted in a sliding sleeve annulus defined between the housing and the ball-seat sleeve, the first sliding sleeve movable between an initial, closed position, wherein the first sliding sleeve blocks fluid communication through the radial housing port, and an open position, wherein fluid communication is allowed through the radial housing port; and a second sliding sleeve slidably mounted in the sliding sleeve annulus defined between the housing and the ball-seat sleeve, the second sliding sleeve movable between an initial position, wherein the second sliding sleeve does not block the radial housing port, and a closed position, wherein the second sliding sleeve blocks fluid communication through the radial housing port;

a first pressure port in the ball-seat sleeve providing fluid communication between the interior passageway and the sliding sleeve annulus above the first sliding sleeve when in its closed position and above the ball seat;

a flow port in the ball-seat sleeve providing fluid communication between the interior passageway and the sliding sleeve annulus below the ball seat and above the first sliding sleeve when in its open position; and a pressure equalization port in the ball-seat sleeve providing fluid communication between the interior passageway and the sliding sleeve annulus below the first sliding sleeve when in its open position.

* * * * *